United States Patent [19]

Nakamura et al.

[11] Patent Number: 4,484,886

[45] Date of Patent: Nov. 27, 1984

[54] COMBUSTION CYLINDER CONSTRUCTION FOR OIL SPACE HEATER OF THE TYPE FOR RADIATING HEAT RAYS

[75] Inventors: Kazuharu Nakamura; Yutaka Nakanishi, both of Nagoya, Japan

[73] Assignee: Toyotomi Kogyo Co., Ltd., Aichi, Japan

[21] Appl. No.: 399,569

[22] Filed: Jul. 19, 1982

[30] Foreign Application Priority Data

| | | | |
|---|---|---|---|
| Jul. 18, 1981 | [JP] | Japan | 56-112787 |
| Jul. 18, 1981 | [JP] | Japan | 56-112788 |
| Dec. 23, 1981 | [JP] | Japan | 56-214071 |

[51] Int. Cl.[3] ..... F23D 5/00

[52] U.S. Cl. ..... 431/201; 431/200; 431/198; 431/309; 431/344; 126/96

[58] Field of Search ..... 431/200, 201, 198, 195, 431/344, 352, 353, 309; 126/95, 96

[56] References Cited

U.S. PATENT DOCUMENTS

| | | | |
|---|---|---|---|
| 2,365,745 | 12/1944 | Castle et al. | 431/198 |
| 2,455,115 | 11/1948 | Lancey | 431/201 |

FOREIGN PATENT DOCUMENTS

| | | | |
|---|---|---|---|
| 35707 | 10/1972 | Japan . | |
| 46678 | 11/1976 | Japan . | |
| 24347 | 8/1979 | Japan . | |
| 112919 | 9/1980 | Japan | 431/201 |
| 146306 | 11/1980 | Japan | 431/201 |
| 763371 | 12/1956 | United Kingdom | 431/201 |

*Primary Examiner*—Randall L. Green

*Attorney, Agent, or Firm*—Pollock, Vande Sande & Priddy

[57] ABSTRACT

A combustion cylinder construction for an oil space heater of the type for radiating heat rays is disclosed which is capable of uniformly red-heating an outer surface of an outer cylindrical member of a double combustion cylinder and efficiently radiating heat rays from the red-hot outer surface and is capable of completely burning an incomplete combustion gas and the like at a flame spreader to form a white-yellow flame and efficiently radiating heat rays from the flame. The outer cylindrical member has through-holes larger than those of an inner cylindrical member and is provided at the upper portion thereof with a recess having through-holes. The combustion cylinder and flame spreader are surrounded by a single heat-permeable cylinder.

19 Claims, 3 Drawing Figures

COMBUSTION CYLINDER CONSTRUCTION FOR OIL SPACE HEATER OF THE TYPE FOR RADIATING HEAT RAYS

BACKGROUND OF THE INVENTION

1. Field of the Invention

This invention relates to an improved combustion cylinder construction for an oil space heater of the type for radiating heat rays, and more particularly to a combustion cylinder construction adapted to efficiently heat a room with heat rays radiated from a red-heated outer cylindrical member of a double combustion cylinder and with heat rays emitted from a white-yellow flame formed at a flame spreading means disposed above the combustion cylinder.

2. Description of the Prior Arts

In an oil space heater of the type for radiating heat rays, there have been conventionally used two kinds of combustion cylinder constructions. One of such constructions is adapted to burn a combustible gas in a space between outer and inner cylindrical members forming a double combustion cylinder to red-heat the cylindrical members and burn an incomplete combustion gas and a combustible gas contained in a combustion gas generated from the combustion cylinder at a flame spreading means disposed above the combustion cylinder to form a long white-yellow flame. In such conventional construction, a path for supplying a combustion air to the combustion cylinder is provided separate from a path for supplying a combustion air to the flame spreading means. That is, a combustion air supplied to the flame spreading means is guided from a space defined between the outer cylindrical member and a transparent heat-permeable cylinder surrounding the combustion cylinder through through-holes of the outer cylindrical member to the flame spreading means, whereas, a combustion air supplied to the combustion cylinder is introduced therein from through-holes of the outer and inner cylindrical members. Therefore, the air supplied to the flame spreading means prevents the outer and inner cylindrical members from being uniformly and efficiently red-heated, because it cools the cylindrical members.

More particularly, the conventional combustion cylinder construction of such type is constructed to carry out the mixing of a fuel oil vaporized from a wick with an air and the combustion of the fuel oil in the space between the inner and outer cylindrical members utilizing an air introduced from the through-holes of the cylindrical members, to thereby render the cylindrical members red-hot. Therefore, when an air supplied from the space between the outer cylindrical member and the heat-permeable cylinder through the through-holes of the outer cylindrical member to the flame spreading means flows in large amounts, the air cools the outer cylindrical member, thereby not allowing the member to be uniformly and efficiently red-heated. In addition, in order that the flame spreading means permits an incomplete combustion gas generated from the combustion cylinder to be stably burned, it is required to generate a strong draft toward the flame spreading means. However, in the conventional construction of such type, the draft causes a large amount of cold air to enter the space through the through-holes of the cylindrical members, resulting in the red-hot cylindrical members being cooled.

The other combustion cylinder construction conventionally used in an oil space heater of the type for radiating heat rays is constructed to guide a combustible gas generated in a space within a double combustion cylinder to the outer surface of an outer cylinder member to burn the gas on the outer surface of the outer cylindrical member, to thereby render the cylindrical member red-hot. Such conventional construction also is adapted to burn an incomplete combustion gas and a combustible gas contained in a combustion gas generated from the combustion cylinder at a flame spreading means disposed above the combustion cylinder. It is known in the art that such conventional construction allows the outer cylindrical member to be uniformly and efficiently red-heated, as compared to the construction as mentioned above.

In such conventional construction, it is known that it is desired to supply a combustion air for the flame spreading means from a space defined between the outer cylindrical member of the double combustion cylinder and a transparent heat-permeable cylinder surrounding the combustion cylinder through through-holes of the outer cylindrical member to the flame spreading means. However, the supply of a combustion air to the flame spreading means has a disadvantage that the air cools the red-hot outer cylindrical member to cause it to be nonuniformly and unstably red-heated, as in the combustion cylinder construction of the type mentioned above.

In addition, such conventional combustion cylinder construction has another disadvantage of causing an oil space heater having the construction incorporated therein to have a great height and a high center of gravity, thereby to render the oil space heater unstable particularly when the heater is tilted for the purpose of, for example, the igniting operation. In order to eliminate the disadvantage, a combustion cylinder construction has been proposed which is constructed to extend another transparent heat-permeable cylinder surrounding the flame spreading means to the lower portion of the oil space heater to surround the combustion cylinder as well. However, such construction has a defect of substantially attenuating heat rays generated from the red-hot outer cylindrical member because the heat rays must be passed through the two heat-permeable cylinders, to thereby decrease the heating efficiency of the oil heater.

BRIEF SUMMARY OF THE INVENTION

The present invention has been made to eliminate the foregoing disadvantages of the prior art.

Accordingly, it is an object of the present invention to provide a combustion cylinder construction for an oil space heater of the type for radiating heat rays capable of uniformly and efficiently red-heating an outer cylindrical member of a double combustion cylinder and allowing heat rays to be efficiently radiated from the red-heated cylindrical member to the outside with a simple structure.

It is another object of the present invention to provide a combustion cylinder construction for an oil space heater of the type for radiating heat rays capable of uniformly red-heating an outer cylindrical member of a double combustion cylinder and allowing heat rays to be efficiently radiated from the red-heated cylindrical member to the outside and also capable of completely burning a combustible gas and an incomplete combustion gas contained in a combustion gas generated from the combustion cylinder at a flame spreading means to form a long stable white-yellow flame and allowing heat rays to be efficiently radiated from the flame to the outside with a simple structure.

It is another object of the present invention to provide a combustion cylinder construction for an oil space heater of the type for radiating heat rays capable of rendering an oil space heater having the combustion cylinder construction incorporated therein stable enough to easily return to the original state when it is unexpectedly tilted, for example, at the igniting operation as well as accomplishing the above-mentioned objects.

It is a further object of the present invention to provide a combustion cylinder construction for an oil space heater of the type for radiating heat rays capable of strengthening a draft at the outside of a flame spreading means to stably and completely burn an incomplete combustion gas and a combustible gas contained in a combustion gas generated from a double combustion cylinder without causing the draft to adversely affect the combustion cylinder in a red-hot state as well.

It is still a further object of the present invention to provide a combustion cylinder construction for an oil space heater of the type for radiating heat rays capable of rendering a draft in a space between a heat-permeable cylinder and an outer cylindrical member of a double combustion cylinder constantly strong as compared to a draft in the combustion cylinder to keep the combustion cylinder red-hot.

In accordance with one aspect of the present invention, there is provided a combustion cylinder construction for an oil space heater of the type for radiating heat rays comprising a double combustion cylinder having an inner cylindrical member and an outer cylindrical member each formed with through-holes and adapted to mix a fuel oil vaporized from a wick with an air introduced from a part of the through-holes to form a combustible gas and burn a part of the combustible gas in a space defined between the inner cylindrical member and the outer cylindrical member; a flame spreading means disposed above the double combustion cylinder; a single transparent heat-permeable cylinder disposed to surround the double combustion cylinder and the flame spreading means; a passage for supplying a combustion air to a space defined between the heat-permeable cylinder and the outer cylindrical member; the through-holes of the outer cylindrical member being divided into upper through-holes, middle through-holes and lower through-holes, the upper and middle through-holes being formed to have a size larger than the through-holes of the inner cylindrical member; the outer cylindrical member being formed with a recess in the circumferential direction thereof between the upper through-holes and the middle through-holes, the recess being formed with a plurality of through-holes arranged in the circumferential direction of the outer cylindrical member.

In accordance with another aspect of the present invention, there is provided a combustion cylinder construction for an oil space heater of the type for radiating heat rays further comprising a partition plate extending from the top end of the outer cylindrical member toward the heat-permeable cylinder to define a gap between the heat-permeable cylinder and the partition plate, the partition plate being provided with a plurality of small through-holes.

In accordance with a further aspect of the present invention, there is provided a combustion cylinder construction for an oil space heater of the type for radiating heat rays further comprising a top plate mounted on each of the cylindrical members of the double combustion cylinder in addition to the first combustion cylinder construction mentioned above; the top plate of the inner cylindrical member being positioned substantially below the top plate of the outer cylindrical members; the top plate of the outer cylindrical member having an outer end extending to the heat-permeable cylinder and an inner end extending above the inner cylindrical member.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Figure 1:
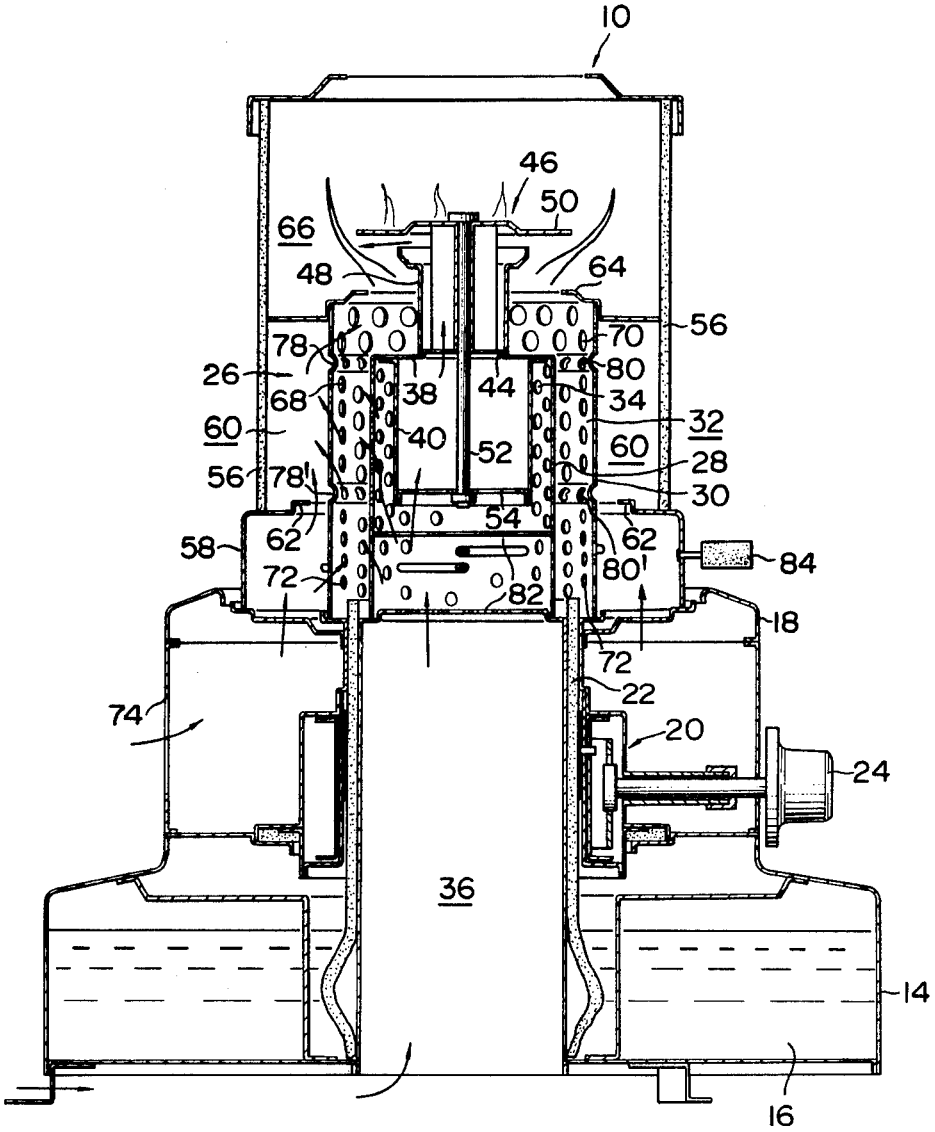
FIG. 1 is a vertical sectional view showing an oil space heater of the type for radiating heat rays which has one embodiment of a combustion cylinder construction according to the present invention incorporated therein.

FIG. 1 illustrates an oil space heater of the type for radiating heat rays which has one embodiment of a combustion cylinder construction according to the present invention incorporated therein. In FIG. 1, an oil space heater and a combustion cylinder construction of the present invention are designated by reference numerals 10 and 12, respectively.

The oil space heater of the type for radiating heat rays shown in FIG. 1 is constructed in such a manner as widely known in the art, except the combustion cylinder construction of the present invention. The oil space heater 10 includes an oil tank 14 for storing therein a fuel oil 16 such as kerosene and a wick receiving case 18. In the wick receiving case 18, a wick moving mechanism 20 is provided which is adapted to move a wick 22 in the vertical direction by a knob 24.

The combustion cylinder construction 12 according to the present invention is disposed on the wick receiving case 18 and includes a double combustion cylinder 26 comprising an inner cylindrical member 28 and an outer cylindrical member 30 disposed concentric with the inner member 28 with a space 32 being defined therebetween. The inner cylindrical member 28 has a plurality of small holes 34 provided therethrough which serve to introduce a part of a combustion air therethrough from the lower portion of an internal cylindrical space 36 defined in the oil space heater to the space 32. The inner cylindrical member 28 also has an annular top plate 38 inwardly extending so as to surround the top portion of a central cylinder 40 disposed in the cylindrical member 28. The top plate 38 has a circular opening 44 defined at the central portion thereof.

On the central cylinder 40, a flame spreading means 46 is mounted through the top plate 38. The flame spreading means includes a cylindrical member 48 mounted on the top plate 38 and a flame spreading plate 50 disposed above the cylindrical member 48 and spaced therefrom. The plate 50 is supported through a bolt 52 by a perforated plate 54 provided at the lower portion of the central cylinder 40. A part of a combustion air for the flame spreading means 46 is supplied from the outside of the oil space heater through the cylindrical space 36 and the cylindrical member 48 to the flame spreading plate 50.

The combustion cylinder construction 12 also includes a single heat-permeable cylinder 56 supported through a non-permeable cylinder 58 on the wick receiving case 18. The heat-permeable cylinder 56 is preferably transparent. The single heat-permeable cylinder 56 is disposed to surround both of the red-hot portion of the outer cylindrical member 30 and the flame spreading means 46, with a space 60 being defined between the heat-permeable cylinder and the member 30. The connecting portion between the cylinders 56 and 58 is provided with a perforated plate 62 extending toward the outer cylindrical member 30 which acts to control a combustion air to be supplied to the space 60.

The outer cylindrical member 30 is provided at the upper portion thereof with an annular top plate 64 which is located in a space defined between the outer cylindrical member 30 and the heat permeable cylinder 56 and extends to the heat-permeable cylinder 56. The top plate 64 acts as a barrier to separate the space 60 from a space 66 defined between the flame spreading plate 50 and the heat-permeable cylinder 56.

The outer cylindrical member 30 has a plurality of holes provided therethrough. Through-holes 68 of the member 30 provided above the perforated plate 62 are larger in size than the through-holes 34 of the inner cylindrical member 28. Upper through-holes 70 provided near the top plate are preferably formed to have a larger size than the middle through-holes 68. Lower through-holes 72 below the perforated plate 62 may be formed to have substantially the same size as the through-holes 34 of the inner cylindrical member 28. The portion of the outer cylindrical member 30 at which the lower through-holes 72 are provided is preferably surrounded by the non-permeable cylinder 58. The lower through-holes 72 act to guide a part of a combustion air for the space 32 from openings 74 provided at the wick receiving case 18 therethrough to the space 32. In the space 32, a fuel oil vaporized from the wick 22 is mixed with a combustion gas introduced through the through-holes 34 of the member 28 and the lower through-holes 72 of the member 30 and is heated to form a combustible gas in the lower portion of the space 32. A part of the combustible gas is burned in the space 32.

The outer cylindrical member 30 also has a recess 78 semi-circular in section provided in the circumferential direction thereof at the boundary portion between the middle through-holes 68 and the upper through-holes 70. The recess 78 has a plurality of holes 80 provided therethrough. A plurality of recesses such as the recess 78 may be provided at the outer cylindrical member 30 at which the through-holes 68 are provided. In the embodiment illustrated, two recesses 78 and 78' are provided which are respectively disposed at the boundary portions between the through-holes 68 and 70 and between the through-holes 68 and 72. The through-holes 68, 70, 72, 80 and 80' may be formed in various shapes such as a slit shape, an elliptic shape and the like as desired, although these are formed in a circular shape in the illustrated embodiment.

Reference numeral 82 designates perforated plates for controlling the flow of a combustion air to be supplied from the cylindrical space 36 to the space 32 and the flame spreading means 46. Reference numeral 84 designates a handle for lifting the combustion cylinder construction when the oil space heater is ignited.

The manner of operation of the combustion cylinder construction shown in FIG. 1 will now be explained.

A fuel oil vaporized from the wick 22 is mixed, in the lower portion of the space 32 between the inner and outer cylindrical members 28 and 30, with a combustion air introduced from the outside of the heater 10 through the through-holes 34 of the inner cylindrical member 28 and the lower through-holes 72 of the outer cylindrical member 30 to form a combustible gas. A part of the combustible gas, when igniting the heater, burns in the middle and upper portions of the space 32 using a combustion air mainly supplied from the through-holes 34 of the inner cylindrical member 28 to heat the members 28 and 30 and produce a combustion gas. The combustion gas has a large volume as compared to the combustible gas, resulting in a draft generated in the space 32 being weakened. And, a draft in the space 60 between the heat-permeable cylinder 56 and the outer cylindrical member 30 becomes larger than the draft in the space 32. This allows a large volume of the combustible gas in the space 32 to be easily sucked through the through-holes 80' of the lower recess 78' and the through-holes 68 of the outer member 30 into the space 60, because the holes 68 are larger in size than the holes 34 of the inner member 28 resulting in the flow resistance of the combustible gas passing through the holes 68 being less. Thus, the combustible gas starts to burn on the outer surface of the outer cylindrical member 30 heated by combustion of a part of the combustible gas in the space 32.

The combustion gas of a high temperature produced by combustion of the combustible gas on the outer surface of the member 30 goes up along the outer surface to uniformly red-heat the outer surface. Then, the combustion gas changes the direction toward the upper recess 78 at the lower portion of the recess and is guided from the through-holes 80 of the recess through the upper portion of the space 32 to the flame spreading means 46. Simultaneously, the combustion gas in the space 32 also is guided to the means 46. Whereas, the combustion air in excess introduced into the space 60 strikes upon the top plate 64 and is guided from the upper through-holes 70 through the upper portion of the space 32 to the flame spreading means. When the through-holes 70 are formed to have a larger size, the combustion air is more effectively guided through the through-holes 70 to the flame spreading means 46. In addition, the through-holes 68 and 70 have an elliptic shape, the combustible gas and combustion gas are more easily passed through the holes 68 and 70, respectively. The combustion air from the space 60 and the inner cylindrical space 36 allows an incomplete combustion gas and a combustible gas contained in the combustion gas to be completely burned in the space 66 to form a white-yellow flame near the flame spreading plate 50. Heat rays generated from the red-hot outer cylindrical member 30 and the white-yellow flame are discharged through the heat-permeable cylinder 56 to the outside of the heater.

Thus, it will be understood that the portion of the outer cylindrical member positioned between the upper recess 78 and the lower recess 78' is uniformly red-heated; because the portion is constantly and uniformly surrounded by the combustion gas of a high temperature formed near the outer surface thereof and the upper recess 78 is strongly heated by the combustion gas in the space 32. Also, it will be understood that the combustion air supplied from the space 60 to the flame spreading means 46 is surely guided through the upper through-holes 70 of the outer cylindrical member 30. Furthermore, it will be noted that the heat rays radiated from the red-hot outer cylindrical member 30 and the white-yellow flame formed at the flame spreading means 46 are efficiently discharged to the outside of the heater to warm a room; because the outer cylindrical member and the flame spreading means are surrounded only by the single heat-permeable cylinder 56, this resulting in attenuation of the heat rays being minimized.

Figure 2:
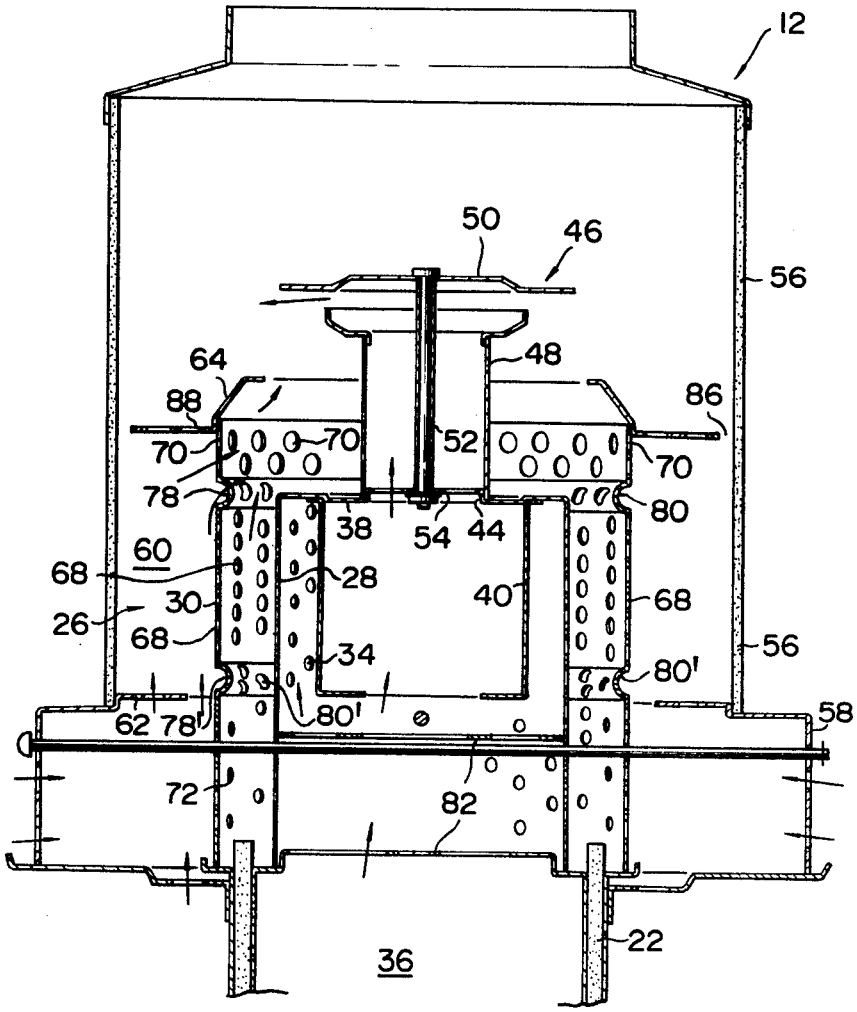
FIG. 2 is a vertical sectional view showing another embodiment of a combustion cylinder construction for an oil space heater of the type for radiating heat rays according to the present invention.

FIG. 2 illustrates another embodiment of a combustion cylinder construction according to the present invention. The embodiment is adapted to completely burn a combustible gas and an incomplete combustion gas contained in a combustion gas generated from a double combustion cylinder at a flame spreading means as well. When a fuel oil is unexpectedly vaporized in large amounts from a wick, a combustion gas generated from the outer surface of an outer cylindrical member of a double combustion cylinder and a space in the combustion cylinder contains a large amount of incomplete combustion gas and combustible gas. The embodiment is intended to completely burn such gases at a flame spreading means. Also, the embodiment is adapted to render an oil space heater having a combustion cylinder construction incorporated therein stable.

In the embodiment of FIG. 2, a top plate 64 of an outer cylindrical member 30 is located in a space defined between the outer cylindrical member 30 and the heat permeable cylinder 56 and disposed to be spaced at the outer end thereof from a transparent heat-permeable cylinder 56 to define an annular gap 86 therebetween and has a plurality of holes 88 provided therethrough. In the embodiment, the heat-permeable cylinder preferably has a large diameter as compared to that of the embodiment shown in FIG. 1. The remaining parts of the embodiment are constructed in the substantially same manner as the embodiment of FIG. 1.

The combustion cylinder construction of the embodiment having the top plate 64 formed in the manner as mentioned above allows a large part of combustion air supplied from a space 60 to the outside of the flame spreading means 46 to be guided through the gap 86 and the through-holes 88 of the top plate 64 in the direction perpendicular to a combustion air supplied from an internal cylindrical space 36 through the inside of the flame spreading means to the outside thereof. This results in a combustion air being supplied in large amounts to the flame spreading means 46 to allow an incomplete combustion gas and a combustible gas contained in a combustion gas which is supplied from the space 60 through a recess 78 and from a space 32 to the flame spreading means to be completely burned at the means 46. Also, this allows a long stable white-yellow flame to be formed at the flame spreading means 46 which extends in the obliquely upward direction, because the combustion air introduced through the gap 86 and the through-holes 88 crosses the combustion air introduced through the inside of the flame spreading means. In such case, when the heat-permeable cylinder 56 has a larger diameter, the combustion of a combustible gas on the outer surface of the outer cylindrical member 30 is carried out using a combustion air flowing near the outer surface and a combustion air flowing near the heat-permeable cylinder is supplied to the outside of the flame spreading means 46.

In addition, in the embodiment of FIG. 2, a non-permeable cylinder 58 is formed to have a diameter substantially larger than the heat-permeable cylinder 56. This permits an oil space heater to be stable enough to easily return to the original state when it is tilted.

Figure 3:
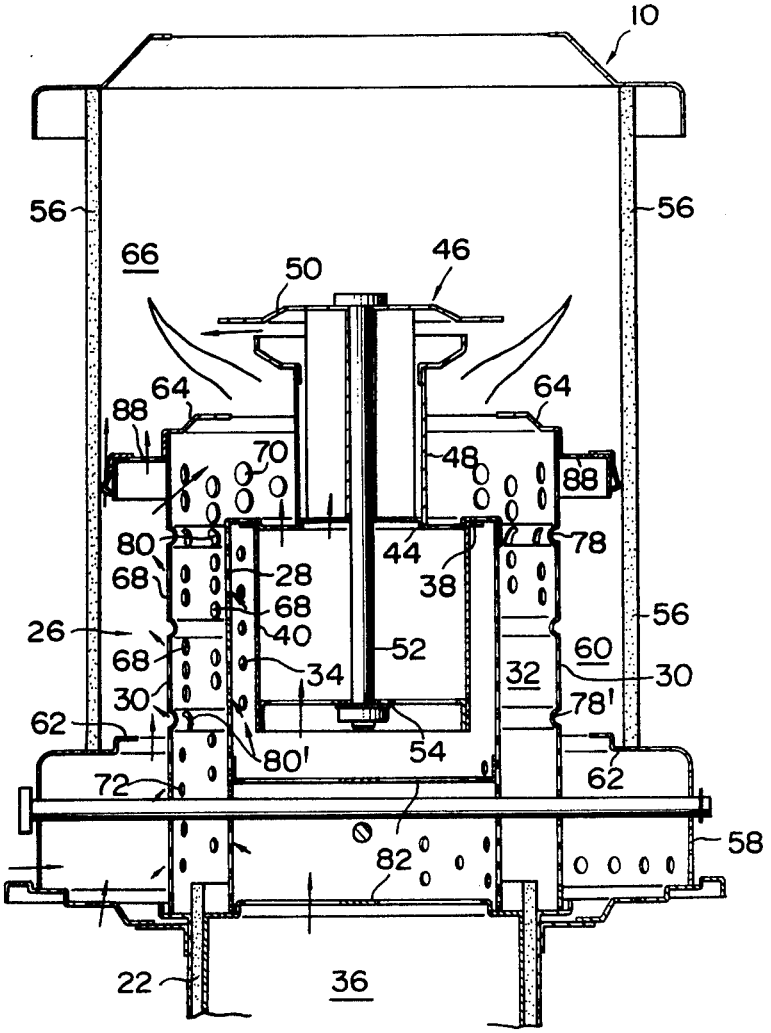
FIG. 3 is a vertical sectional view showing a further embodiment of a combustion cylinder construction for an oil space heater of the type for radiating heat rays according to the present invention.

FIG. 3 illustrates a further embodiment of a combustion cylinder construction according to the present invention. The embodiment is constructed to strengthen a draft at the outside of a flame spreading means to allow the flame spreading means to stably and completely burn an incomplete combustion gas and a combustible gas contained in a combustion gas generated from a double combustion cylinder without causing the draft to adversely affect the combustion cylinder in a red-hot state. The embodiment is also adapted to render a draft in a space between a heat-permeable cylinder and an outer cylindrical member of a double combustion cylinder constantly strong as compared to a draft in the combustion cylinder to keep the combustion cylinder in a stable red-hot state.

The embodiment is constructed in such a manner that the top end of an inner cylindrical member 28 is disposed substantially below a top plate 64 of an outer cylindrical member 30 and the top plate 64 has an outer end which is located in a space defined between the outer cylindrical member 30 and the heat permeable cylinder 56 and extends to a heat-permeable cylinder 56 so as to isolate a space 60 from a space 66 except small through-holes 88 of the top plate 64. The inner end of the top plate 64 extends above the inner cylindrical member 28. The portion of a top plate 38 of the inner cylindrical member 28 extending to a central cylinder 40 may be provided with a small holes for supplying a part of a combustion air therethrough to a flame spreading means 46. The remaining parts of the embodiment are constructed in the substantially same manner as the embodiment of FIG. 1.

In the embodiment of FIG. 3 constructed as mentioned above, the top plate 64 of the outer cylindrical member 30 effectively prevents a draft generated in a space 66 from affecting a space 32 in the double combustion cylinder 26, because the inner end of the top plate 64 extends above the inner cylindrical member 28; so that an area of a strong negative pressure may be formed in a space above the top plate 38 of the inner cylindrical member 28. In addition, the top end of the inner cylindrical member is positioned substantially below the top plate 64 of the outer cylindrical member 30 and upper through-holes 70 of the outer cylindrical member 30 are formed in size larger than through-holes 34 of the inner cylindrical member 28. Thus, a gas in a space 60 rather than that in the space 32 is sucked by the negative pressure area, resulting in a draft in the space 60 being constantly higher than a draft in the space 32.

While preferred embodiments of the invention have been described with a certain degree of particularity, obvious modifications and variations are possible in light of the above teachings. It is therefore to be understood that within the scope of the appended claims, the invention may be practiced otherwise than as specifically described.

What is claimed is:

1. A combustion cylinder construction for an oil space heater of the type for radiating heat rays, comprising:

a double combustion cylinder comprising an inner cylindrical member and an outer cylindrical member each formed with through-holes and adapted to mix a fuel oil vaporized from a wick with an air introduced from a part of said through-holes to form a combustible gas and burn a part of said combustible gas in a space defined between said inner cylindrical member and said outer cylindrical member;

a combustion chamber formed above said double combustion cylinder;

a flame spreading means arranged in said combustion chamber so as to be positioned above said inner cylindrical member;

a heat-permeable cylinder arranged to surround said double combustion cylinder and said combustion chamber;

a partition means extending between the top portion of said outer cylindrical member and said heat permeable cylinder, the bottom wall of said combustion chamber being defined by said partition means;

a passage for supplying a combustion air to a space defined between said heat-permeable cylinder and said outer cylindrical member; and said through-holes of said outer cylindrical member being divided into upper through-holes, middle through-holes and lower through-holes, said upper and middle through-holes being formed to have a size larger than said lower through-holes so that substantially all air to be introduced directly to the exterior of said flame spreading means is supplied directly through said space between said heat permeable cylinder and said outer cylindrical member.

2. A combustion cylinder construction as defined in claim 1, wherein said outer cylindrical member is formed with a recess in the circumferential direction thereof between said upper through-holes and said middle through-holes, said recess being formed with a plurality of through-holes which are arranged in the circumferential direction of said outer cylindrical member and having a semi-circular shape.

3. A combustion cylinder construction as defined in claim 2, wherein said heat-permeable cylinder is supported on a non-permeable cylinder which is disposed to surround the portion of said outer cylindrical member at which said lower through-holes are provided.

4. A combustion cylinder construction as defined in claim 3, wherein an air for forming said combustible gas and burning a part of said combustible gas in said space between said inner and outer cylindrical members is introduced from said through-holes of said inner cylindrical member and said lower through-holes of said outer cylindrical member into said space.

5. A combustion cylinder construction as defined in claim 4, wherein said outer cylindrical member is also provided with another recess in the circumferential direction thereof between said middle through-holes and said lower through-holes, said another recess being formed with a plurality of through-holes arranged in the circumferential direction of said outer cylindrical member.

6. A combustion cylinder construction as defined in claim 5, wherein said upper through-holes of said outer cylindrical member have a size larger than said middle through-holes thereof.

7. A combustion cylinder construction as defined in claim 6, wherein said upper and middle through-holes of said outer cylinder member are formed in an elliptic shape.

8. A combustion cylinder construction as defined in claim 1, wherein said partition means comprises a top plate of said outer cylindrical member.

9. A combustion cylinder construction as defined in claim 1, wherein there is a single heat permeable cylinder.

10. A combustion cylinder construction as defined in claim 1, wherein said heat-permeable cylinder is transparent.

11. A combustion cylinder construction for an oil space heater of the type for radiating heat rays comprising:

a double combustion cylinder comprising an inner cylindrical member and an outer cylindrical member each formed of through-holes and adapted to mix a fuel oil vaporized from a wick with an air introduced from a part of said through-holes to form a combustible gas and burn a part of said combustible gas in a space defined between said inner cylindrical member and said outer cylindrical member;

a first top plate mounted on said inner cylindrical member;

a second top plate mounted on said outer cylindrical member;

a flame spreading means disposed above said first and second top plates to burn a combustible gas and an incomplete combustion gas contained in a combustion gas generated by said double combustion cylinder to form a white-yellow flame;

a heat-permeable cylinder disposed to surround said double combustion cylinder and said flame spreading means;

a passage for supplying a combustion air to a space defined between said heat-permeable cylinder and said outer cylindrical member;

the top end of said inner cylindrical member being positioned substantially below said second top plate;

said second top plate having an outer end extending to said heat-permeable cylinder and an inner end extending above said inner cylindrical member;

said through-holes of said outer cylindrical member being divided into upper through-holes, middle through-holes and lower through-holes, said upper and middle through-holes being formed to have a size larger than said through-holes of said inner cylindrical member;

said outer cylindrical member being formed with a recess in the circumferential direction thereof between said upper through-holes and said middle through-holes, said recess being formed with a plurality of through-holes which are arranged in the circumferential direction of said outer cylindrical member.

12. A combustion cylinder construction as defined in claim 11, wherein said recess has a semi-circular shape in section.

13. A combustion cylinder construction as defined in claim 12, wherein said heat-permeable cylinder is supported on a non-permeable cylinder which is disposed to surround the portion of said outer cylindrical member at which said lower through-holes are provided.

14. A combustion cylinder construction as defined in claim 13, wherein an air for forming said combustible gas and burning a part of said combustible gas in said space between said inner cylindrical member and said outer cylindrical member is introduced from said through-holes of said inner cylindrical member and said lower through-holes of said outer cylindrical member into said space.

15. A combustion cylinder construction as defined in claim 14, wherein said upper through-holes have a size larger than said middle through-holes.

16. A combustion cylinder construction as defined in claim 15, wherein said upper and middle through-holes are formed in an elliptic shape.

17. A combustion cylinder construction as defined in claim 16, wherein said outer cylindrical member is also provided with another recess in the circumferential direction thereof between said middle through-holes and said lower through-holes, said another recess being formed with a plurality of through-holes arranged in the circumferential direction of said outer cylindrical member.

18. A combustion cylinder construction as defined in claim 17, wherein said second top plate is provided at the portion extending to said heat-permeable cylinder with a plurality of small through-holes.

19. A combustion cylinder construction as defined in claim 19, wherein said heat-permeable cylinder is transparent.

* * * * *